US008891949B2

(12) United States Patent
Hong et al.

(10) Patent No.: US 8,891,949 B2
(45) Date of Patent: Nov. 18, 2014

(54) MICRO-FLUIDIC PUMP

(75) Inventors: Eunki Hong, Lexington, KY (US); Steven Bergstedt, Winchester, KY (US); Yimin Guan, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 211 days.

(21) Appl. No.: 13/556,495

(22) Filed: Jul. 24, 2012

(65) Prior Publication Data

US 2013/0202278 A1 Aug. 8, 2013

Related U.S. Application Data

(60) Provisional application No. 61/594,559, filed on Feb. 3, 2012.

(51) Int. Cl.
*F24H 1/08* (2006.01)
*F04B 19/24* (2006.01)

(52) U.S. Cl.
USPC ..... 392/471; 417/207; 417/208; 417/209

(58) Field of Classification Search
None
See application file for complete search history.

(56) References Cited

U.S. PATENT DOCUMENTS 4,318,114 A 3/1982 Huliba
5,375,979 A * 12/1994 Trah ..... 417/52
6,071,081 A * 6/2000 Shiraishi ..... 417/52
6,283,718 B1 9/2001 Prosperetti
6,299,673 B1 * 10/2001 Field et al. ..... 96/185
6,431,694 B1 8/2002 Ross
6,655,924 B2 12/2003 Ma
6,685,303 B1 2/2004 Trauernicht
6,869,273 B2 3/2005 Crivelli
7,374,274 B2 5/2008 Cornell
2005/0072559 A1 * 4/2005 Ippoushi et al. ..... 165/104.13
2008/0118790 A1 * 5/2008 Kim et al. ..... 429/13
2012/0007921 A1 1/2012 Govyadinov

OTHER PUBLICATIONS

Jr-Hung Tsai and Liwei Lin, A Thermal Bubble-Actuated Micro-Nozzle-Diffuser Pump, Journal of Mircoelectromechanical Systems, vol. 11, No. 6, Dec. 2002.

Jung-Yeul Jung and Ho-Young Kwak, Fabrication and Testing of Bubble Powered Micropumps using Embedded Microheater, Research Paper, Department of Mechanical Engineering, Chung-Ang University, Seoul, South Korea, Received Jun. 16, 2006, Accepted Aug. 1, 2006, Published online Sep. 16, 2006, Springer-Verlag.

D.J. Laser and J.G. Santiago, A review of Micropumps, Journal of Micromechanics and Microengineering, 14 (2004) pp. R-35-R-64, Institute of Physics Publishing.

Jun et al., Microscale Pumping with Traversing Bubbles in Microchannels, Solid-State Sensor and Actuator Workshop, Hilton Head Island, South Carolina, Jun. 3-6, 1996.

* cited by examiner

*Primary Examiner* — Thor Campbell

(57) ABSTRACT

A micro-fluidic pump comprises one or more channels having an array of resistive heaters, an inlet, outlet and a substrate as a heat sink and a means of cooling the device. The pump is operated with a fire-to-fire delay and/or a cycle-to-cycle delay to control the pumping rate and minimize heating of liquid inside the pump during its operation.

20 Claims, 9 Drawing Sheets

MICRO-FLUIDIC PUMP

CROSS REFERENCES TO RELATED APPLICATIONS

This application claims the benefit and priority of U.S. provisional patent application Ser. No. 61/594,559, filed Feb. 3, 2012, entitled Micro-Fluidic Pump, whose contents are incorporated herein by reference as if set forth herein.

STATEMENT REGARDING FEDERALLY SPONSORED RESEARCH OR DEVELOPMENT

None

REFERENCE TO SEQUENTIAL LISTING, ETC.

None

BACKGROUND

1. Field of the Disclosure

This present disclosure generally relates to a pump. More specifically, it relates to a pump which forms thermal bubbles to transport liquid through a channel or deliver liquid from a reservoir to a channel of micro-fluidic devices. Resistive heaters configured to flow fluid in channels about a chip facilitate certain designs, as do techniques for controlling them. Thermal control facilitates other designs.

2. Description of the Related Art

Micro-fluidic devices manipulate microscopic volumes of liquid inside micro-sized structures. Applications of such devices include precise liquid dispensing, drug delivery, point-of-care diagnostics, industrial and environmental monitoring and lab-on-a-chip. Especially, lab-on-a-chip devices can provide advantages over conventional and non-micro-fluidic based techniques such as greater efficiency of chemical reagents, high speed analysis, high throughput, portability and low production costs per device allowing for disposability.

Micro-fluidic devices can be built by combining several components like channels, connectors, filters, mixers, chemical reactors, sensors, micro-valves, micro-fluidic pumps and etc. Among these components, it is well known to be difficult to attain micro-fluidic pumps which are ready to be assembled with micro-fluidic devices at low costs. For example, while a range of micro-fluidic devices have been miniaturized to the size of a postage stamp, these devices have often required large external pneumatic pumping systems for their operation. Moreover, to make portable and handheld point-of-care diagnostic and lab-on-a-chip devices, a small, reliable and disposable micro-fluidic pump is an indispensable component.

Micro-fluidic pumps generally fall into two groups: mechanical pumps and non-mechanical pumps. Mechanical pumps use moving parts which exert pressure on the liquid. Piezoelectric pumps and thermo-pneumatic pumps are included in this group. Usually, these pumps have complex structures and are difficult to manufacture at low costs. In addition, their size is large making them a major drawback for integration with smaller micro-fluidic devices. Among non-mechanical pumps, electro-osmotic pumps have been studied for micro-fluidic applications. An electro-osmotic pump uses surface charges that spontaneously develop when a liquid contacts with a solid. When an electric field is applied, the space charges drag a body of the liquid in the direction of the electric field. A disadvantage of this kind of pump is its high operation voltage and low flow rate.

Another example of a non-mechanical pump is a pump exploiting thermal bubbles. By expanding and collapsing either a bubble with diffusers or bubbles in a coordinated way, a thermal bubble pump can transport liquid through a channel. Several types of thermal bubble pumps have been proposed—for example, in U.S. Pat. No. 6,283,718 to Prosperetti (2001), U.S. Pat. No. 6,655,924 to Ma (2003) and U.S. Pat. No. 6,869,273 to Crivelli (2005). While the art described different ways to transport liquid using thermal bubbles, they failed to disclose how to make small, reliable and disposable pumps which are ready to be assembled with micro-fluidic devices at low cost. Moreover, the art overlooked the thermal effects of the thermal bubble pumps to the liquids transported. Since heat sensitive liquids are often used in micro-fluidic devices, the art is delinquent in understanding thermal aspects of thermal bubble pumps and should be considered. In addition, because properties of a liquid such as viscosity and energy required to generate the supercritical bubbles depend on the liquid temperature, a bubble pump needs to maintain the liquid temperature to a predetermined set point to control the pumping rate.

Thus, there is a need for a reliable and disposable micro-fluidic pump, which is ready to be combined with micro-fluidic devices. In addition, it is necessary to understand how to fabricate and operate a pump of this type to minimize the adverse thermal effects to the liquid transported.

SUMMARY OF THE INVENTION

The above and other problems become solved with a micro-fluidic pump activating resistive heaters to transport liquid (fluid) through a channel of micro-fluidic devices. The device includes a substrate supporting pluralities of thin-film heaters. A cover layer above and spaced from the heaters defines a channel with a volume space in which fluid flows sequentially from one heater to a next heater without escaping the cover layer. Arrangements of the heaters in the channel define certain embodiments as do pumping rates and schemes for controlling activation of the heaters.

In representative embodiments, the pump is operated by activating the heaters inside the channel in a predetermined way. The heaters are fired with a fire-to-fire delay and/or a cycle-to-cycle delay to control the pumping rate. Heating of the liquid transported is minimized by using a means of cooling the pump during its operation.

DETAILED DESCRIPTION

The following describes a pump which forms thermal bubbles in order to transport liquid through channels or deliver liquid from a reservoir to channels in micro-fluidic devices and a method for using the pump to achieve a predetermined pumping rate and minimize the thermal effects of the pump to the liquid transported.

In many micro-fluidic applications such as liquid dispensing, point-of-care diagnostics or lab-on-a-chip, a role of micro-fluidic pumps is to manipulate micro-volumes of a variety of liquids inside micro-channels. In many cases, liquids used for these applications are heat sensitive. For example, blood cells can be degraded at temperature above 50° C. For this reason, when a micro-fluidic pump exploiting thermal bubbles is applied to transport liquid in a micro-fluidic device, it should be considered how to prevent overheating of the liquid.

Thermal bubbles from a liquid can be formed by either normal boiling or supercritical heating. When the temperature of a liquid reaches its boiling temperature by a heater, vapor bubbles are heterogeneously formed on nucleation sites on the surrounding surface which contact with the heated liquid. In this case, a body of the liquid on the heater will experience an increase of the temperature up to the boiling point. For water, it is 100° C. which most heat sensitive liquids cannot endure.

On the other hand, vapor bubbles can be formed homogeneously by the supercritical heating of a liquid. While the supercritical temperature of a liquid is higher than the boiling point, only a thin layer of the liquid is involved in forming thermal vapor bubbles. For example, while the supercritical temperature of water is about 300° C., the thermal bubbles can be formed by heating less than 0.5 μm thick layer of water on top of the heater to the supercritical temperature for a few micro-seconds. For a 50 μm deep channel formed on such a pump, less than one percent of the liquid will experience the supercritical temperature. In addition, it will last for a few micro-seconds and the temperature of most of the liquid will maintain at the initial temperature of the pump. Thus, compared to the normal heating, by using the supercritical heating of a liquid, a thermal bubble pump can minimize the thermal effects to the liquid and prevent overheating of a body of the liquid. In addition, a high initial pressure of around 100 Atm generated by the bubbles results in the advantage of using the bubbles to pump the liquid. The pump described below implements the supercritical heating of a liquid inside the channel to transport it.

Figure 1:
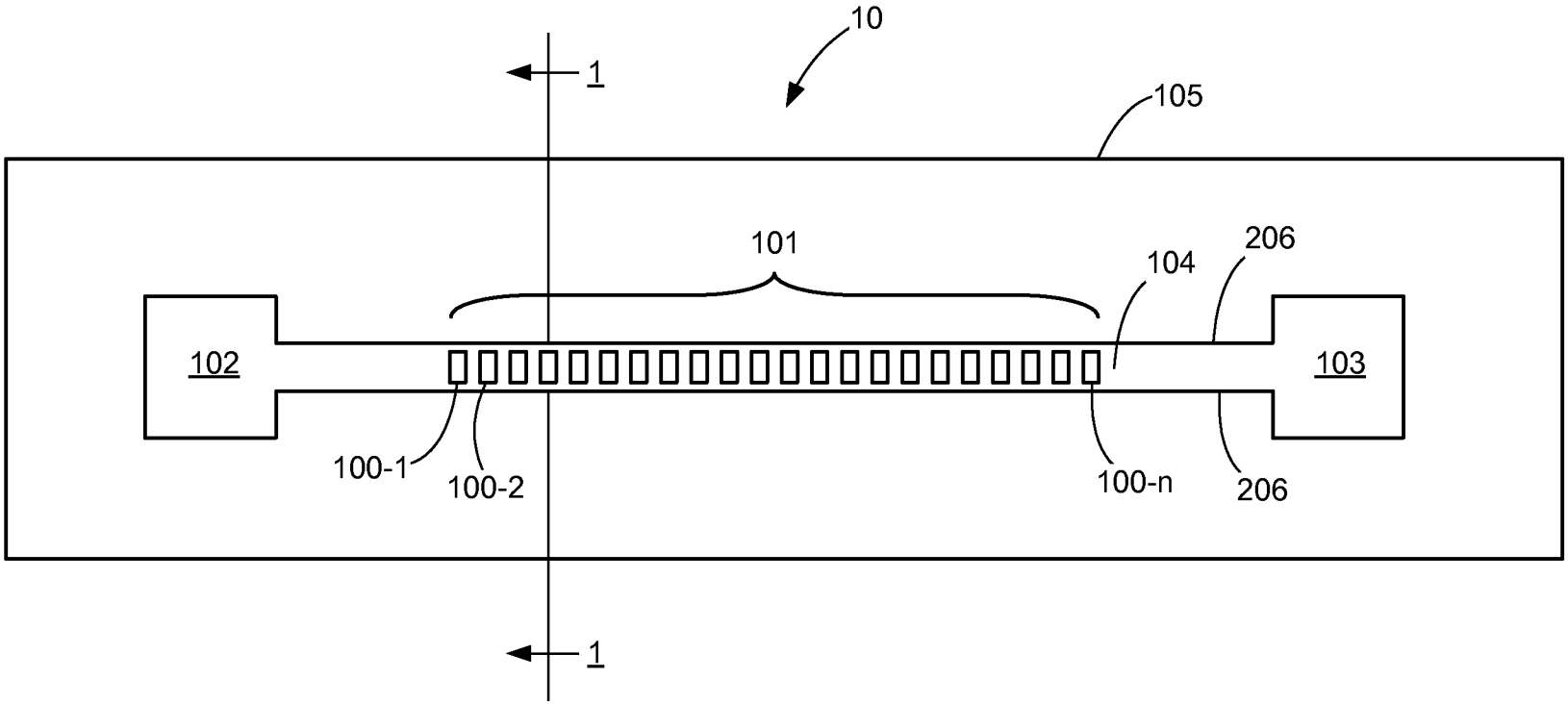
FIG. 1 is a schematic view of a micro-fluidic pump.

FIG. 1 shows one embodiment of a micro-fluidic pump 10. It includes a plurality 101 of individual resistive heaters 100 (100-1 . . . 100-n) in a channel 104. An inlet 102 and outlet 103 serve to introduce and remove fluid from the channel. As will be described in more detail below, the heaters 101 and the fluidic structures 102, 103, 104 are formed on a substrate 105. In its operation, by applying a voltage pulse to each of the heaters, thermal bubbles are formed in a predetermined manner. For example, every heater can form a bubble from the left to the right of the channel in sequence to push the liquid in the same direction. This cycle is then repeated to continue the pumping. In addition, by firing each of the heaters in the opposite sequence, the flow of the liquid can be reversed. In these cases, the following needs to be considered to operate the pump properly. When a heater is fired, it should be allowed to cool down to its initial temperature before it is fired again in the next cycle. If not, the heater will build up heat with time and eventually cause the liquid on top of the heater to boil, which can degrade the liquid if it is heat sensitive. Therefore, to operate the pump at a fast frequency to obtain a high pumping rate, the stack of materials on the substrate beneath the heater should be engineered to provide a proper cooling rate sufficient enough to prevent heat from building up in the heater. At the same time, the temperature of the substrate should not be over-heated. Since a large portion of energy from the heater will be dissipated through the substrate, either a passive or active means for cooling the substrate is required to use the pump for an extended period of time.

Figure 2:
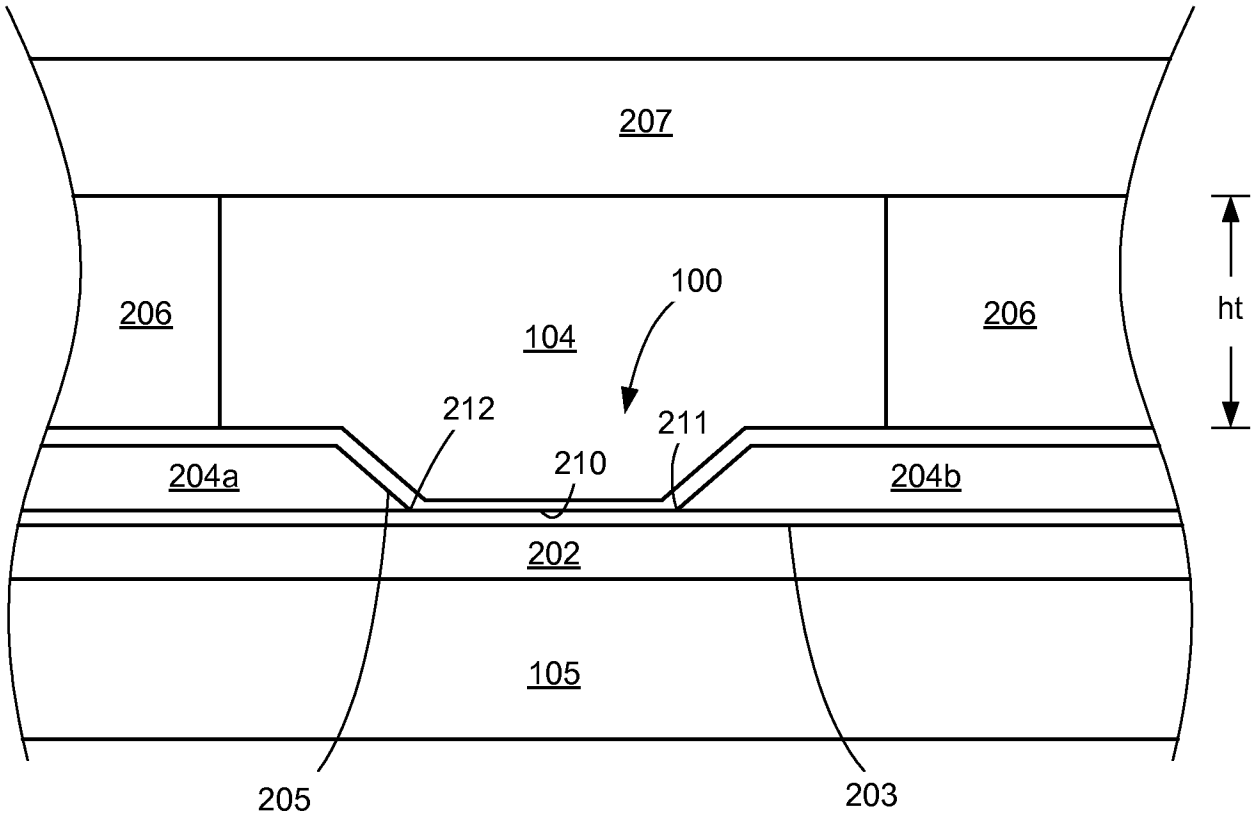
FIG. 2 is a cross-sectional view of the micro-fluidic pump taken along line 1-1 of FIG. 1.

FIG. 2 shows the stack structure of the pump taken along the length of a resistive heater. The stack comprises a substrate 105, a thermal insulating layer 202, a resistive heater layer, such as a heater metal 203, a conductive layer 204, a cavitation layer 205, a flow feature layer 206 and a cover layer 207. (It should be noted that FIG. 2 is not an exact cross sectional view of FIG. 1. That is, the cover layer 207 above the channel 104 if illustrated in FIG. 1 would prevent the illustration of the underlying individual resistive heaters 100. Hence, the cover layer 207 is not present in FIG. 1.) The thermal insulating layer 202 has a function to increase energy transfer from the heater into the liquid inside the channel 104 and reduce energy loss into the substrate. At the same time, by forming the insulating layer with a proper thickness, the heater can cool down at a predetermined rate after it is fired. (The heater 100 is defined by the conductive layer on a surface 210 of the heater metal, such as between positions 211, 212. The conductive layer is also bifurcated into electrode sections, anode 204*a* and cathode 204*b*, to energize the heater to operate as is known in the art.) In addition, the substrate 105 should be thermally conductive to dissipate heat from the heater to the surroundings effectively. The cavitation layer 205 is required to improve the reliability of the heater. The flow feature layer 206 defines walls and together with the cover layer 207 forms the channel 104 of the pump in which fluid flows. Unlike traditional nozzle plates over heaters used in inkjet printing, however, the cover layer here has no nozzle holes to eject fluid for printing. Rather, the cover layer 207 retains the fluid in the channel 104 as bounded by the walls 206 and sequential activation of heaters by the conductive layer moves fluid from one heater to a next without escaping the cover layer. In this way, fluid is moved about the substrate according to a path of travel on the substrate defined by walls of the channel. Fluid is only removed and introduced from the substrate at predefined inlet or outlet ports, such as those illustrated in FIG. 1. A height (ht) of the flow feature layer 206 is also noted to illustrate heights of the walls of the channel on the substrate thereby defining a volume space in which the fluid can flow in the channel. In practice, the inventors have constructed walls at heights of eighteen (18) and forty (40) microns, but preferred heights range from 10 μm to 100 μm as described below. Other heights are possible.

Figure 3:
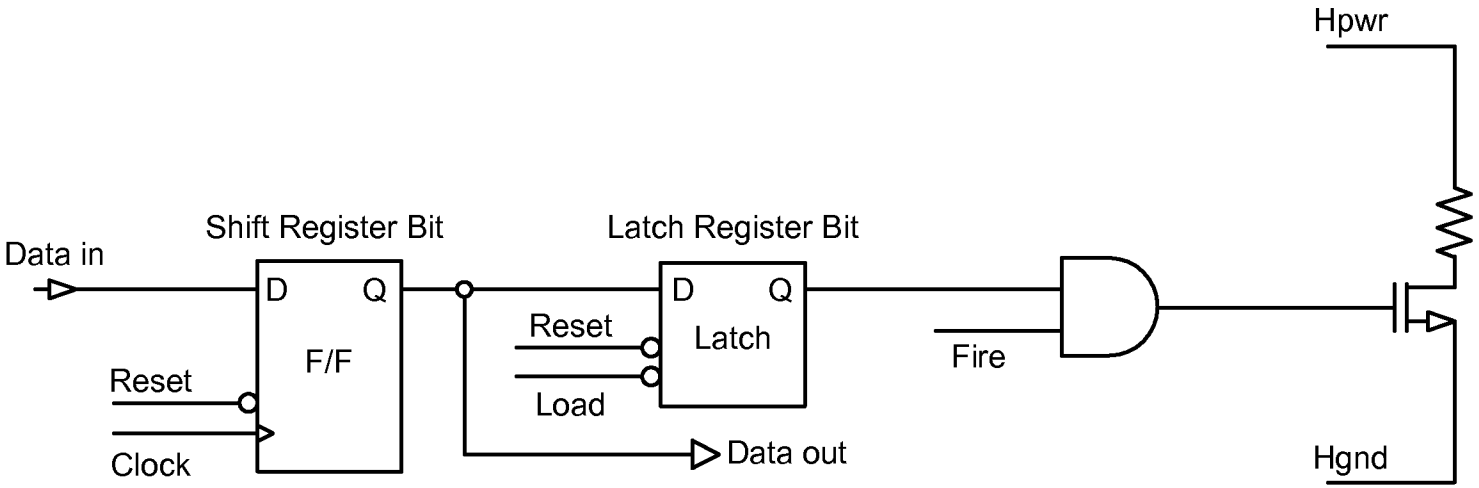
FIG. 3 is a schematic view of logic circuits for driving a micro-fluidic pump.

Logic circuits shown in FIG. 3 can be used to control and drive the micro-fluidic pump. The logic circuits can include AND gates, latches, shift registers, power transistors or the like. For this circuitry, there are five signal lines: Clock, Fire, Reset, Data and Load. In addition, power and ground connections to the heaters are provided by Hpwr and Hgnd respectively. The Reset signal is used to set the logic states of the shift registers to zero. The data signal is connected to the input shift register composed of D flip-flops. The data clocked into the shift register corresponds to the pump heater(s) that will be fired on the next fire cycle. After the data is shifted another register of latches holds the state(s) for the next pump firing cycle. When the predetermined width of the fire signal is applied to the AND gate, the heaters selected by the logic states of the latches are activated for the width of the fire signal. In this way, the shift register can be continuously clocked while the pump heaters are fired from the holding latches. Such logic circuits can be assembled with a pump as a separate chip or can be formed on a single chip along with a pump. Especially, a pump with integrated logic circuits on a single chip is advantageous since the pump can be fabricated with a small footprint at a low cost and be operated with minimum signal delays. Of course, other control and drive techniques are possible.

The pump is fabricated on a substrate. The preferred substrate is silicon, which allows forming logic circuits together with the pump. In addition, silicon provides high thermal conductivity to help heaters cool down at a fast rate. Logic circuits to control heaters are formed on the substrate by silicon processing. The heater stacks are then formed with the fluidic structures. For the heater stack (202, 203, 204 and 205) shown in FIG. 2, a silicon oxide is grown or deposited as the insulating layer 202 on top of the silicon substrate 105. The thickness of the oxide layer is in the range of 0.5 μm to 5.0 μm. The preferred thickness is 1.8 μm, which allows the heater to be fired a second time 20 μsec after a first time. As the heater metal 203, TaAlN, TaAl or other thin film resistor materials can be used. The preferred heater metal is TaAlN deposited by sputtering. The preferred thickness and sheet resistance are 30 nm and 350 ohm/square. For a heater of 29×17μm$^2$ in rectangular planar size ($H_L \times H_w$, FIG. 4), the resistance is around 600 ohms. A conductive layer 204 is deposited on top of the heater metal. As the conductive layer, Au, Al, AlCu, Ni can be used. The preferred conductive layer is AlCu. The conductive layer and heater metal are patterned by wet etching and dry etching processes to form the heaters and interconnections. A stack of silicon nitride and Ta layers is used as the cavitation layer 205. The preferred thicknesses of the silicon nitride and Ta layers are 200 nm and 250 nm, respectively. Silicon nitride can be deposited by PECVD and the Ta layer can be deposited by sputtering. The silicon nitride forms an electrical insulation between the heater metal and the Ta layer, which also could be other single layer or multilayer structures such as SiC/SiN, DLC and silicon oxide. A photoimageable polymer, for example, SU-8 (MicroChem, Newton, Mass.), is used to form the flow feature layer 206. The height is in the range of 10 μm to 100 μm. The preferred thickness is 40 μm. For the cover layer 207, a photoimageable dry film, for example, VACREL™ (DuPont) is used and applied onto the flow feature by a lamination process. The height is in a range of 10μm to 100μm. The preferred thickness of the cover layer is 14 μm. An inlet and outlet are formed by either deep reactive ion etching (DRIE) or a photolithography process. By DRIE, an inlet and outlet ports can be formed by etching holes through the substrate. In this case, liquid is fed into the pump from the backside. An inlet and outlet can be formed on the top side of the pump by patterning the flow feature and cover layer. In addition, both DRIE and photolithography processes can be used to make an inlet on the top side and outlet on the backside of the pump.

Figure 4A:
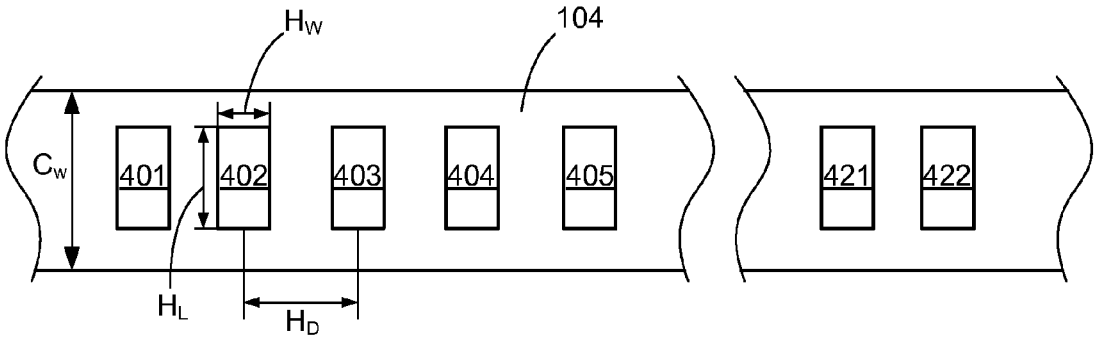
FIGS. 4A-4D are plan views of micro-fluidic pumps showing resistive heaters inside channels.
Figure 4B:
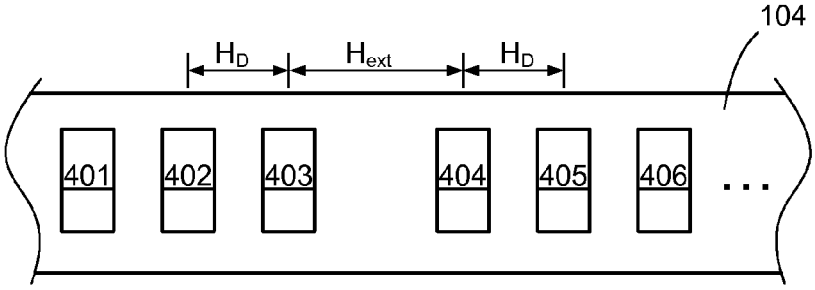
Figure 4C:
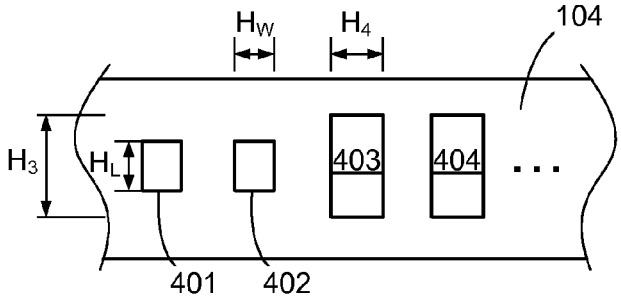
Figure 4D:
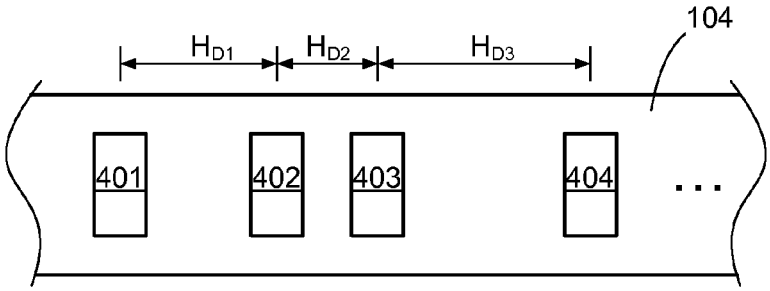

FIG. 4A describes the arrangement of heaters inside the channel of a pump. To obtain a proper pumping rate of over 0.1 μl/min from the pump with heaters in a predetermined size, the geometric relationships among the heaters and between the heaters and the channel are important. The heaters inside the channel are required to satisfy the following conditions. The ratio of the width of the channel ($C_W$) to the length of the heaters ($H_L$) is in the range of 1.0 to 2.0. The spacing ($H_D$) between two adjacent heaters is in the range of 1.5 $H_W$ to 4 $H_W$. For pumps out of these ranges, the pumping rates are significantly reduced for the preferred pump structure and the operation conditions described above. For example, a pump with the spacing ($H_D$) larger than 4 $H_W$ showed a low pumping rate of less than 0.1 μl/min at the condition where a pump with the spacing of 1.5 $H_W$ showed over 10 μl/min. The preferred ratio of $C_W$ to $H_L$ is 1.72 and the preferred spacing ($H_D$) is 56 μm. The size of a heater determines the required energy per fire. For the pump disclosed in this invention, the length and width is in the range of 10 to 100 μm. The preferred length and width are 29 μm and 17 μm, respectively. With reference to FIG. 4B, alternate embodiments note that situations may arise whereby extended gaps ($H_{ext}$) reside between otherwise symmetrically spaced heaters having equidistant spacing ($H_D$). In FIG. 4C, still other embodiments contemplate heater lengths and widths having dissimilar sizes in a common channel 104. That is, resistive heaters 401, 402 may be substantially the same in planar shape ($H_L \times H_w$) but resistive heaters 403, 404 may be alternatively sized in planar shape ($H_3 \times H_4$) and be larger or smaller. Mixing varieties of such heaters in a common channel is also possible. In FIG. 4D, still other embodiments note asymmetrically spacing adjacent heaters from one another. Distances $H_{D1}$, $H_{D2}$ and $H_{D3}$ are noted whereby $H_{D3}>H_{D1}>H_{D2}$. Of course, other schemes are possible including mixing concepts with one another as illustrated in FIGS. 4A-4D.

Figure 5A:
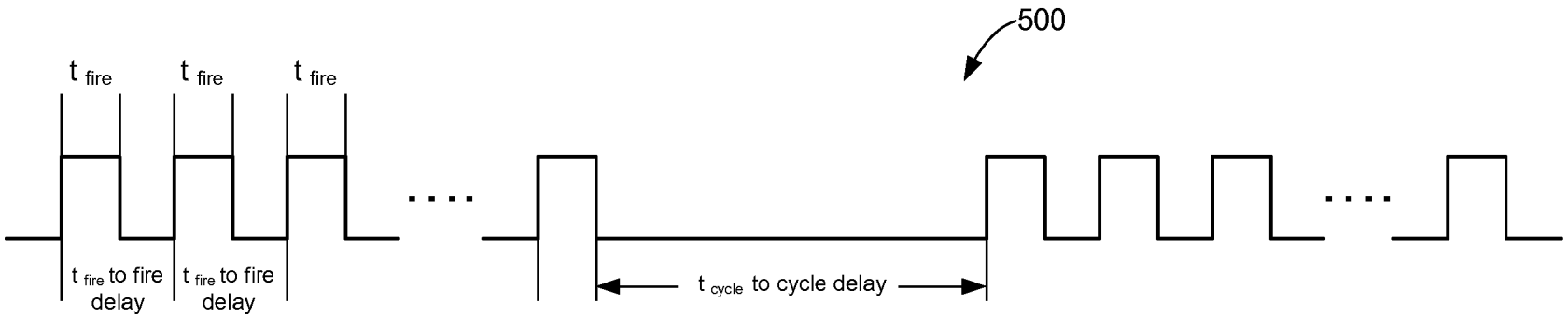
FIGS. 5A-5B are diagrams of fire pulse trains to drive a micro-fluidic pump.
Figure 5B:
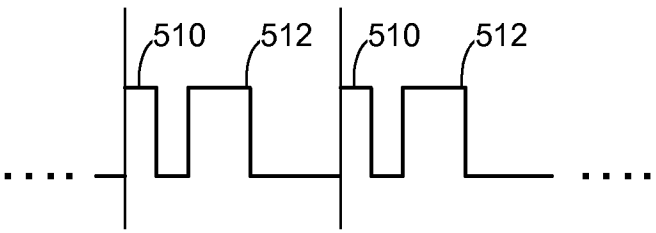

The micro-fluidic pump is operated by firing heaters inside the channel in sequence. For example, assuming that 22 heaters are involved in a pumping operation, each heater from 401 to 422 in FIG. 4 can be activated or fired in sequence. After the last heater 422 is fired, the cycle repeats, starting again from 401. In principle, when a bubble grows on a heater, the previously generated bubble needs to block the channel effectively and prevent the liquid from flowing back in the opposition direction of the sequence. Two delays can be considered to optimize the performance of the pump. After one heater is fired, a delay can be added before the next heater is fired. It is called "fire-to-fire delay." In addition, after a cycle is completed, a delay can be inserted before the next cycle is started. This delay is called "cycle-to-cycle delay." These two delays and the width of the fire pulse can be controlled by manipulating a fire signal 500 shown in FIG. 5A. As shown $t_{fire}$ corresponds to the width of the fire pulse, for which one resistive heater is activated. On the other hand, $t_{fire\text{-}to\text{-}fire\ delay}$ is a time delay between activating two adjacent resistive heaters with a firing pulse. A duty cycle of the $t_{fire\text{-}to\text{-}fire\ delay}$ is noted as being 50% in FIG. 5A. In other embodiments, however, the duty cycle can vary. Duty cycles of 80-90% have been successfully tested and others contemplated. In still other embodiments, FIG. 5B, the activation of one resistive heater can be accomplished with a split firing pulse having a first pulse width 510 to "warm up" the resistive heater and a second pulse width 512 to actually nucleate a bubble of fluid. Of course, other schemes as possible. Finally, $t_{cycle\text{-}to\text{-}cycle\ delay}$ is a time delay between two cycles.

Figure 6:
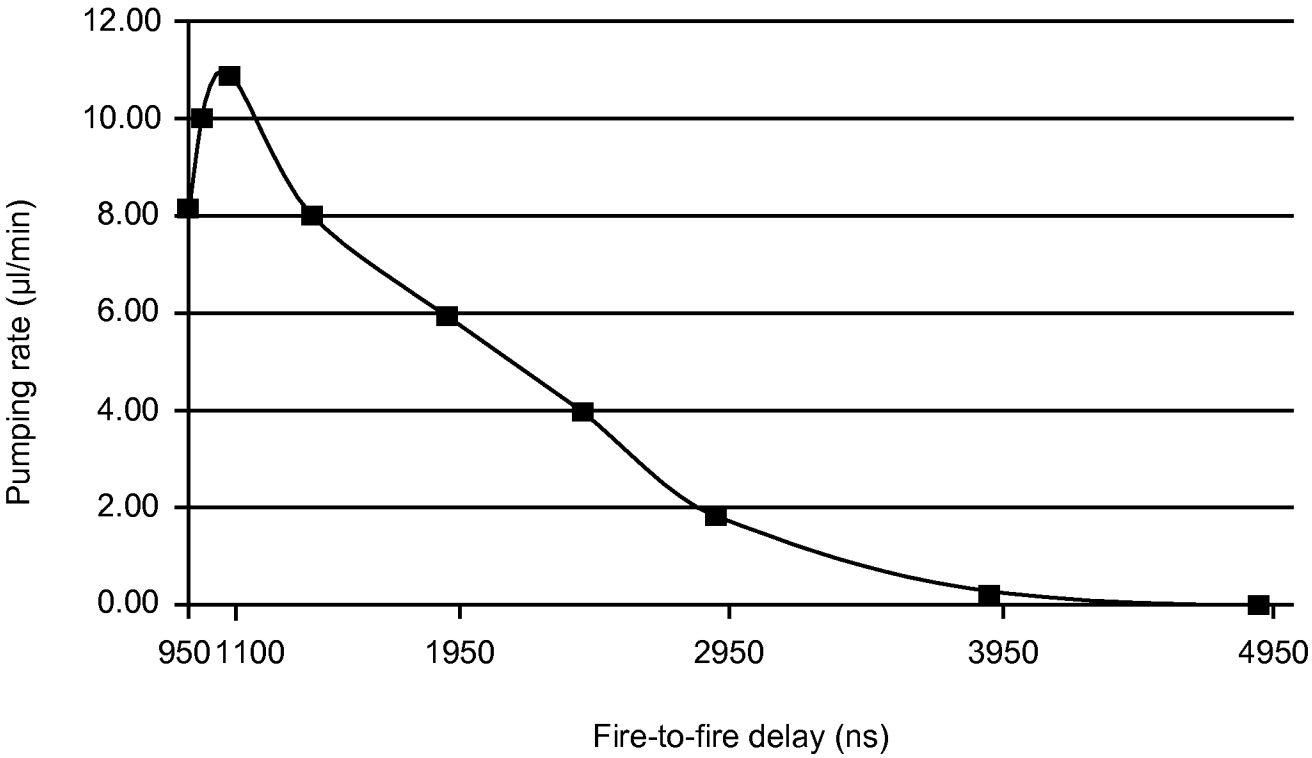
FIG. 6 is a graph illustrating the pumping rate of a micro-fluidic pump versus fire-to-fire delay.
Figure 7:
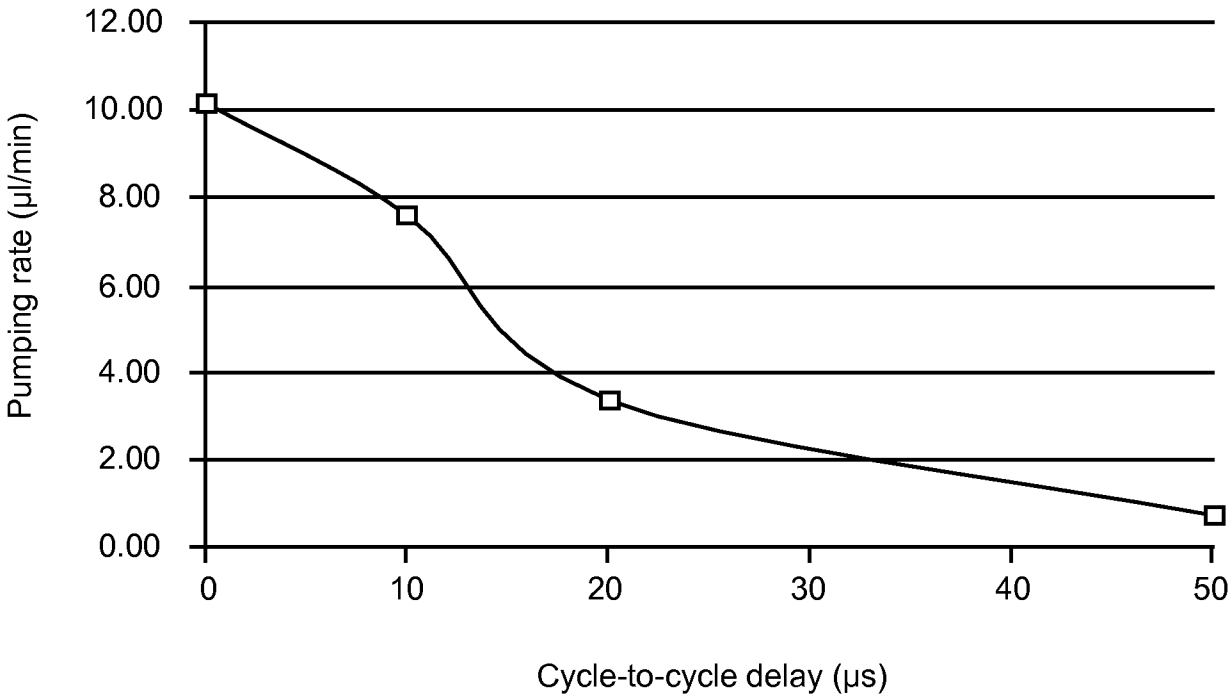
FIG. 7 is a graph illustrating the pumping rate of a micro-fluidic pump versus cycle-to-cycle delay.

FIGS. 6 and 7 show pumping rates of pumps with respect to these delays. In one test case example, the heater size of the pump was 29×17 μm$^2$ and the resistance was around 600 ohms. The operation voltage was 23V, resulting in the power density of around 1.8 GW/m$^2$. To induce the supercritical heating of an aqueous liquid, the power density falls between 1.0 GW/m$^2$ and 3 GW/m$^2$. The fire pulse width ($t_{fire}$) was 900 ns and the liquid comprised 79.8% water, 9% 1, 3 propanediol, 9% glycerol, 1.5% dye and additives such as surfactant and biocide. When a heater is activated inside the channel, a bubble nucleates at about 500 ns. The bubble then reaches the maximum volume at about 1.5 μs after the nucleation. The bubble completely collapses at about 3 μs. At its largest, the size of the bubble is slightly larger than the size of the heater. This relationship explains why the ratio of the width of the channel to the length of the heater is related to pump performance. When the channel is much wider than the length of the heater, the bubble cannot block the channel effectively. Therefore, when adjacent heaters are energized to produce bubbles, backflow in the channel reduces the effective pumping rate. FIG. 6 shows the pumping rate of a pump with respect to a fire-to-fire delay in ranges from 950 ns to 4950 ns without any cycle-to-cycle delay. As shown, there is an optimum fire-to-fire delay which maximizes the pumping rate. The maximum pumping rate is about 11 μL/min and the pump rate per cycle is about 4 pL/cycle. Each heater was activated at a frequency of about 41 kHz. From this maximum, the pumping rate decreases monotonously with the delay increase.

FIG. 7 shows the pumping rate of a pump with respect to a cycle to cycle delay in the range of 0 to 50 μs. In this example, the fire-to-fire delay is set to be 1100 ns. The pumping rate is decreased by increasing the delay. As shown in these FIGS. 7 and 8, the pumping rates are sensitive to these delays and can be controlled by tuning these delays. The maximum pumping rate is obtained at a fire-to-fire delay of 1100 ns with no cycle to cycle delay. To use this condition, the number of heaters involved has to be decided by considering the cooling time of a heater after the heater is fired. For example, in the stack with 1.8 μm thick silicon oxide on a silicon substrate described in FIG. 4, the cooling time is to be about 20 μs. To activate heaters in the pump without any cycle delay and provide enough time for the heaters to cool down after fired. The number of heaters in the operation needs to satisfy Equation 1, rounded to the next whole number.

$$\text{number \# of resistive heaters} = t_{cooling}/t_{(fire\text{-}to\text{-}fire\ delay)} \qquad \text{Equation 1,}$$

where $t_{cooling}$ is the time required to cool down a resistive heater to its initial temperature after having been activated. For a fire-to-fire delay of 1100 ns and a cooling time of 20 μsec, the minimum number of heaters in the pump is 19 (i.e, 20 μsec/1100 ns=18.18 rounded up to 19). To use heaters less than this value, a proper cycle-to-cycle delay should be used to give enough time for cooling down heaters.

The power consumption, when the pump is operated with a fire-to-fire delay of 1100 ns without a cycle to cycle delay, is around 600 mW. Without any means of forced cooling, for example, a pump of 3 by 10 mm in size mounted on a PCB board heats up to 100° C. within 30 sec. This heating issue can be overcome in a variety of ways. One approach is to drive the pump at a lower power input by increasing the fire-to-fire delay and/or the cycle-to-cycle delay with sacrifice of the pumping rate. Another approach is to use a means to cool down the pump.

Figure 8:
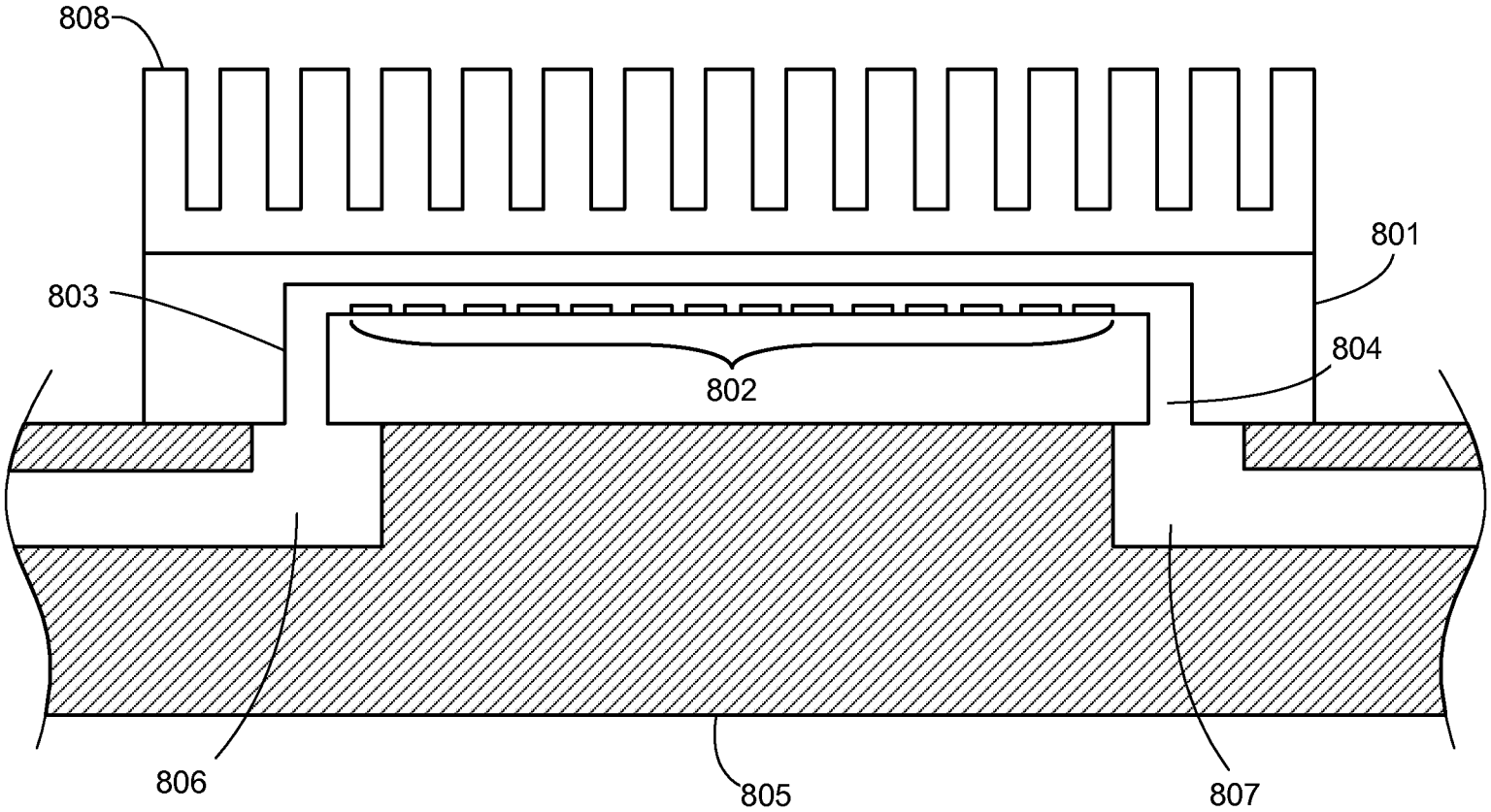
FIG. 8 is a diagram of a micro-fluidic pump mounted as a lab-on-a-chip device with thermal control by way of a heat sink on top of the pump.

FIG. 8 shows an embodiment of a micro-fluidic pump mounted on a lab-on-a-chip device with a heat sink on top of the pump. The pump 801 has an inlet 803 and outlet 804 formed through the substrate. A series of heaters 802 are located between the inlet and outlet. The inlet and outlet of the pump are aligned and disposed on port holes 806, 807 of the lab-on-a-chip 805. A pressure sensitive adhesive or an epoxy adhesive is used to bond the pump on the chip. A cooling fin is attached on top of the pump as a mean of cooling. Along with the fin structure 808, a fan (not shown in FIG. 8) can be used to enhance the cooling of the pump. The fin structure can be made out of Al, aluminum alloys, Cu, diamond or composite materials like copper-tungsten. In addition, to maintain a certain temperature of the pump, either on-chip temperature sensors or external sensors mounted on the pump can be used to adjust the speed of the fan. For electrical connection for the pump to an external controller, a ribbon cable can be used. In another way, the pump chip can be connected to the external controller by connecting electrical pads on the pump to electrical leads formed on the lab-on-a-chip device. The electrical connection can be achieved by either wire-bonding or solder balls formed on either the pads or the leads.

Figure 9:
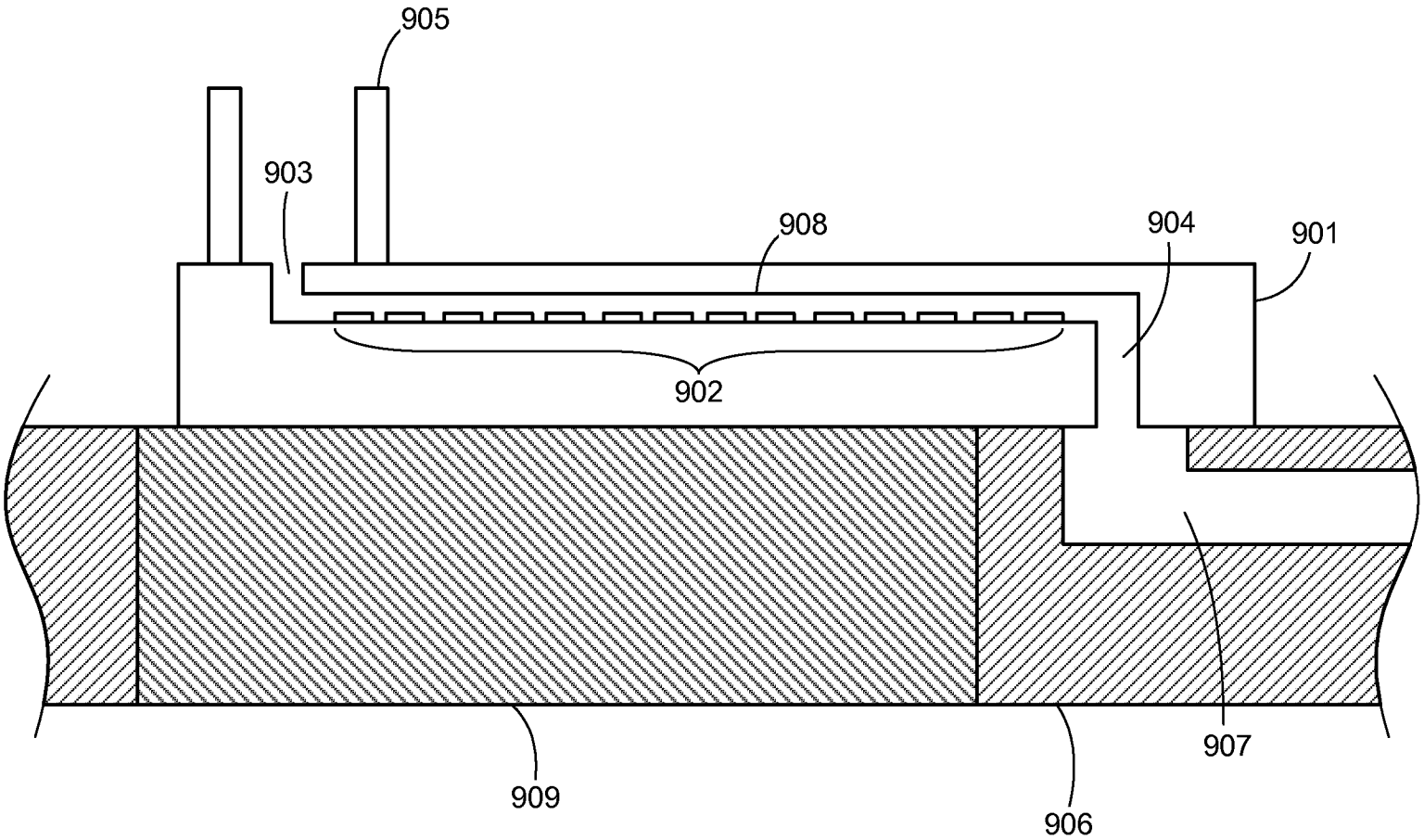
FIG. 9 is a diagram of a micro-fluidic pump mounted as a lab-on-a-chip device with thermal control by way of a heat sink beneath the pump.

In another embodiment, a micro-fluidic pump can be a top-side inlet and bottom-side outlet as shown in FIG. 9. The top-side inlet 903 can be formed by opening up the fluidic structure including a flow feature and a cover layer and DRIE of silicon can be used to form the bottom-side outlet 904. In addition, the side wall of the bottom-side outlet 904 can have a hydrophobic coating to form a capillary stop valve. Such hydrophobic coating can be formed on the side of the outlet by Bosch process which uses fluorocarbon gases like $C_4F_8$ to passivate the side wall during the etch process. The pump can be mounted on a lab-on-a-chip device as shown in FIG. 9. The outlet 904 of the pump are aligned and disposed on the port hole 907 of the lab-on-a-chip 906. A series of heaters 902 are located between the inlet and outlet. Referring again to FIG. 9, one liquid container 905 adjacent the inlet 903 can be attached. In this configuration, when a liquid is applied into the liquid container, the channel 908 will be primed spontaneously by capillary force. The liquid will stop at the capillary valve formed on the outlet 904. In addition, a highly thermal conductive material can be used as a heat sink base 909 beneath the substrate of the pump 901 to dissipate heat from the pump to the surroundings effectively. Also, the conductive material can be mounted on a thermoelectric cooler or cooled down using a fan to keep the temperature to the predetermined level. The conductive material can be made out of Al, aluminum alloys, Cu, diamond or composite materials like copper-tungsten.

In other embodiments, main failure mechanisms of the foregoing kinds of thermal bubble pump are due to cavitation. Cavitation of a bubble generates a shock wave strong enough to sputter the heater metal and the cavitation layer, which eventually make the heater fail. To improve the reliability of a pump, redundant heaters can be formed. For example, when 22 heaters are required for its operation, 44 heaters can be formed on the pump and separated into two groups. By using the two groups of heaters properly, the reliability of the pump is improved by a factor of 2 while maintaining the pump rate. In addition, the pumping rate can be increased by combining multiple pumps in-parallel. For example, when three pumps are combined in-parallel, the pumping rate can be increased by a factor of 3. Compared to increasing the heater size, this kind of parallel combination of a pump allows using the same operation condition like that for a single pump.

Thus, a micro-fluidic pump and method of using the same is disclosed. The foregoing description of several methods and embodiments has been presented for purposes of illustration. It is not intended to be exhaustive or to limit the disclosure to the precise acts and/or forms disclosed, and obviously many modifications and variations are possible in light of the above teaching.

The invention claimed is:

1. A micro-fluidic pump, comprising:

a substrate;

a plurality of resistive heaters on the substrate; and a cover layer above and spaced from the resistive heaters defining a channel with a volume in which fluid in the channel can flow from one heater to a next heater of the resistive heaters at a rate of over 0.1 μl/min without escaping the cover layer, wherein a minimum number of the resistive heaters in the channel corresponds to a ratio of a time required to cool down one resistive heater to an initial temperature after having been activated and another time between activating two adjacent said resistive heaters.

2. The pump of claim 1, wherein the resistive heaters have a rectangular planar shape including a heater length and heater width and the channel has a channel width such that a ratio of the channel width to the heater length is in a range from about 1.0 to about 2.0.

3. The pump of claim 1, wherein the resistive heaters have a heater width and a spacing between two adjacent said resistive heaters is in a range from about 1.0 to about 4,0 times said heater width.

4. The pump of claim 1, wherein the resistive heaters electrically connect to circuitry for activation.

5. The pump of claim 1, further including a flow feature layer on the substrate defining upstanding wails under the cover layer.

6. The pump of claim 5, wherein the walls have a height in a range from about 10 to about 100 microns.

7. The pump of claim 6, wherein the height is about 40 microns.

8. The pump of claim 5, wherein the resistive heaters number at least nineteen resistive heaters adjacent to one another in the channel between said upstanding walls and some of the resistive heaters are asymmetrically positioned adjacent one another.

9. A micro-fluidic pump, comprising:

a substrate;

a plurality of resistive heaters on the substrate; and a cover layer above and spaced from the resistive heaters defining a channel with a volume in which fluid can flow sequentially from one heater to a next heater of the resistive heaters without escaping the cover layer, wherein the resistive heaters have a rectangular planar shape including a heater length and heater width and the channel has a channel width such that a ratio of the channel width to the heater length is in a range from about 1.0 to about 2.0 , wherein a minimum number of the resistive heaters in die channel corresponds to a ratio of a time required to cool down one resistive heater to an initial temperature after having been activated and another time between activating two adjacent said resistive heaters.

10. The pump of claim 9, wherein the heater length and the channel width extend parallel to one another.

11. The pump of claim 9, wherein a spacing between two adjacent said resistive heaters is in a range from about 1.0 to about 4,0 times said heater width.

12. A micro-fluidic pump, comprising:

a substrate;

a plurality of resistive heaters on the substrate;

a cover layer above and spaced from the resistive heaters defining a channel with a volume in which fluid can flow sequentially on the substrate from one heater to a next heater of the resistive heaters without escaping the cover layer, wherein the resistive heaters have a rectangular planar shape including a heater length and heater width and a spacing between two adjacent heaters is in a range of 1.0 to 4.0 times the heater width; and a flow feature layer on the substrate defining upstanding walls under the cover layer, wherein a minimum number of the resistive heaters adjacent to one another in the channel between said upstanding walls equal the ratio of $t_{cooling}/t_{(fire\text{-}to\text{-}fire\ delay)}$, rounded up to a next whole number, whereby $t_{cooling}$ is a time required to cool down one resistive heater to an initial temperature after having been activated and $t_{(fire\text{-}to\text{-}fire\ delay)}$ is a time between activating two adjacent said resistive heaters.

13. The pump of claim 12, wherein the spacing between each of the resistive heaters is substantially equidistant.

14. The pump of claim 12, wherein the spacing of all the resistive heaters is symmetrical along the channel.

15. A micro-fluidic pump, comprising;

a substrate;

a series of resistive heaters on the substrate;

a cover layer above the resistive heaters defining a channel with a volume space in which fluid in the channel can flow sequentially from one heater to a next heater of the resistive heaters without escaping the cover layer; and a plurality of cooling fins above the cover layer to dissipate heat during use, wherein a minimum number of the resistive heaters in the channel corresponds to a ratio of a time required to cool down one resistive heater to an initial temperature after having been activated and another time between activating two adjacent said resistive heaters.

16. A micro-fluidic pump, comprising:

a substrate;

a series of resistive heaters on the substrate;

a cover layer above the resistive heaters defining channel with a volume space in which fluid in the channel can flow sequentially from one heater to a next heater of the resistive heaters without escaping the cover layer; and a heat sink base mounted beneath the substrate to dissipate heat during use, wherein a minimum number of the resistive heaters in the channel corresponds to a ratio of a ratio of time required to cool down one resistive heater to an initial temperature after having been activated and another time between activating two adjacent said resistive heaters.

17. The pump of claim 16, further including a liquid container.

18. The pump of claim 17, further including a fluid inlet port to introduce the fluid in the channel to flow past the series of resistive heaters, the liquid container being mounted adjacent the fluid inlet port.

19. The pump of claim 18, further including a fluid outlet port beneath the fluid inlet port, the liquid container holding said fluid to prime the channel through capillary action.

20. The pump of claim 16, wherein the heat sink base is a thermally conductive material.

* * * * *